US009692177B2

(12) United States Patent
Li et al.

(10) Patent No.: US 9,692,177 B2
(45) **Date of Patent: *Jun. 27, 2017**

(54) ELECTRICAL CONNECTOR ASSEMBLY AND CONNECTING MEMBER THEREOF

(71) Applicant: Molex, LLC, Lisle, IL (US)

(72) Inventors: Yue-You Li, Dongguan (CN); Xiao-An Wang, Dongguan (CN)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/256,016

(22) Filed: Sep. 2, 2016

(65) Prior Publication Data

US 2016/0372864 A1 Dec. 22, 2016

Related U.S. Application Data

(63) Continuation of application No. 14/210,960, filed on Mar. 14, 2014, now Pat. No. 9,461,374.

(30) Foreign Application Priority Data

Mar. 15, 2013 (CN) ..... 2013 1 0085290
Mar. 15, 2013 (CN) ..... 2013 2 0121550 U

(51) Int. Cl.
*H01R 13/62* (2006.01)
*H01R 13/627* (2006.01)
*H01R 9/16* (2006.01)

(52) U.S. Cl.
CPC ..... *H01R 13/6273* (2013.01); *H01R 9/16* (2013.01); *H01R 13/6275* (2013.01)

(58) Field of Classification Search
CPC .. H01R 13/62; H01R 13/627; H01R 13/6271; H01R 13/6272; H01R 13/6273;
(Continued)

(56) References Cited

U.S. PATENT DOCUMENTS 5,123,071 A 6/1992 Mulholland et al.
5,315,679 A 5/1994 Baldwin et al.
(Continued)

FOREIGN PATENT DOCUMENTS

CN 2764017 Y 3/2006
TW M267684 U 6/2005

*Primary Examiner* — Amy Cohen Johnson
*Assistant Examiner* — Matthew T Dzierzynski
(74) *Attorney, Agent, or Firm* — James A. O'Malley

(57) ABSTRACT

An electrical connector assembly and a connecting member thereof, the connecting member comprises: a base portion having an upper surface and a lower surface which are opposite. A first connecting portion comprising two first protruding ribs spaced apart from each other and protruding upwardly from the upper surface of the base portion and two first latching grooves respectively provided at opposite inner sides of the two first protruding ribs, and the two first latching grooves extends along a front-rear direction. A second connecting portion comprising four upright extending walls spaced apart from each other and extending downwardly out from the lower surface of the base portion and four first latching flanges respectively extending horizontally out from the four upright extending walls. A resilient latching arm extending out from one end of the base portion, having a first positioning portion provided to an upper surface thereof and a second positioning portion provided to a lower surface thereof. The connecting member can assemble two cable connector assemblies together and then fix them to an application device, which is convenient during assembling.

17 Claims, 12 Drawing Sheets

(58) Field of Classification Search
CPC .... H01R 13/6275; H01R 9/16; G02B 6/3879; G02B 6/3807
USPC ..... 385/55, 59
See application file for complete search history.

(56) References Cited

U.S. PATENT DOCUMENTS

| | | | | |
|---|---|---|---|---|
| 5,553,180 | A | 9/1996 | Belenkiy et al. | |
| 6,461,187 | B2 | 10/2002 | Chen | |
| 6,572,276 | B1 | 6/2003 | Theis et al. | |
| 6,669,376 | B2 | 12/2003 | Cheng | |
| 6,814,499 | B2 | 11/2004 | Finona | |
| 7,850,370 | B2 | 12/2010 | Murano | |
| 8,727,638 | B2 | 5/2014 | Lee et al. | |
| 8,764,308 | B2 | 7/2014 | Irwin et al. | |
| 8,834,038 | B2 | 9/2014 | Limbert et al. | |
| 9,461,374 | B2 * | 10/2016 | Li ..... | H01R 9/16 |

* cited by examiner

ELECTRICAL CONNECTOR ASSEMBLY AND CONNECTING MEMBER THEREOF

CROSS REFERENCE TO RELATED APPLICATIONS

The Present Disclosure is a continuation of U.S. patent application Ser. No. 14/210,960, filed on 14 Mar. 2014 with the United States Patent and Trademark Office, which issued as U.S. Pat. No. 9,461,374 on Oct. 4, 2016, which application claims priority to prior-filed Chinese Patent Application No. 201310085290.X, filed on 15 Mar. 2013 with the Chinese Patent Office and prior-filed Chinese Patent Application No. 201320121550.X, filed on 15 Mar. 2013 with the Chinese Patent Office. The content of the aforementioned Patent Applications are fully incorporated by reference in their entirety herein.

BACKGROUND OF THE PRESENT DISCLOSURE

The Present Disclosure relates, generally, to an electrical connector assembly and a connecting member thereof, and, more particularly, to a connecting member capable of assembling two or more electrical connectors together.

As personal consumer electronic products (such as GPS, MP3 players, mobile phones, U disks, DVD players, etc.) become increasingly widely used, a single electrical connector interface (such as a Mini-USB Interface), provided originally on an application device (such as an automobile, a display device) has already become insufficient. Accordingly, adding new electrical connector interfaces is required to meet requirements for simultaneous use of a plurality of consumer electronic products. Therefore, a new electrical connector assembly structure is required to simultaneously fix a plurality of electrical connectors to the application device.

Chinese Patent Application No. 200420118681.3, the content of which is hereby incorporated herein in its entirety, discloses an electrical connector fixing device, which can assemble at least one electrical connector inside a machine body of an electronic device. The fixing device comprises a housing provided on the machine body, and includes at least an electrical connector receiving space structure portion and a pressing plate structure portion. The electrical connector receiving space structure portion is used for providing the electrical connector. The pressing plate structure portion is used for allowing compression deformation of the electrical connector receiving space structure to clamp and fix the electrical connector. A retaining piece engages and fixes the housing to the machine body and is capable of pressing the pressing plate structure portion. The retaining piece comprises a first connecting piece fixedly provided to the machine body and a second connecting piece engaged with the first connecting piece. This electrical connector fixing device can clamp and fix the electrical connector only after the second connecting piece and the first connecting piece, which is locked on the machine body, are engaged with each other, which is inconvenient during assembling. Therefore, it is necessary to improve the conventional electrical connector fixing device.

SUMMARY OF THE PRESENT DISCLOSURE

The technical problems to be resolved by the Present Disclosure overcomes the above deficiencies, and provides an electrical connector assembly and a connecting member thereof. The connecting member can assemble two or more cable connector assemblies together and then fix to an application device. The connecting member is formed integrally with latching and positioning structures. The two or more cable connector assemblies can be assembled together without using other retaining pieces, which is convenient during assembling.

In view of the above technical problems, the Present Disclosure provides an connecting member comprising a base portion, a first connecting portion, a second connecting portion, and a resilient latching arm. The base portion comprises an upper surface and a lower surface. The first connecting portion comprises two first protruding ribs, spaced apart from each other and protruding upwardly from the upper surface of the base portion, and two first latching grooves, respectively provided at opposite inner sides of the two first protruding ribs. The two first latching grooves extend along a front-rear direction. The second connecting portion comprises at least two upright extending walls, spaced apart from each other and extending downwardly out from the lower surface of the base portion, and at least two first latching flanges, respectively extending horizontally out from the at least two upright extending walls. The resilient latching arm extends out from one end of the base portion, and comprises first and second positioning portions provided to upper and lower surfaces thereof, respectively.

In one embodiment, a front end of the first latching groove of the first connecting portion is provided with a first stopping portion, and an underside of the first latching groove is provided with a first protruding portion protruding upwardly from the upper surface of the base portion. In another embodiment, the connecting member is integrally formed by injection molding, the base portion is provided with two notches which are positioned between the two first protruding ribs, spaced apart from each other and opened at a front end of the base portion. The resilient latching arm protrudes forwardly at inner sides of the two notches.

In another embodiment, the first positioning portion of the resilient latching arm is a first protruding block provided close to a front end of the resilient latching arm and protruding upwardly, the first protruding block has a first inclined guide surface which is higher at the front and lower at the rear. In another embodiment, the second positioning portion of the resilient latching arm is at least a second protruding block provided close to the front end of the resilient latching arm and protruding downwardly, the second protruding block has a second inclined guide surface which is lower at the front and higher at the rear.

In another embodiment, the second connecting portion comprises four upright extending walls spaced apart from each other and extending downwardly out and four first latching flanges extending horizontal out respectively from the four upright extending walls, and the two adjacent upright extending walls positioned at one side and the two first latching flanges extending oppositely out from bottom ends of the adjacent two upright extending walls form a first connecting unit. The two adjacent upright extending walls positioned at the other side and the two first latching flanges extend oppositely out from bottom ends of the two adjacent upright extending walls at the other side form a second connecting unit. In another embodiment, the two first latching flanges of the first connecting unit and the two first latching flanges of the second connecting unit are positioned in a same horizontal plane. In an embodiment, a front end surface of the first latching flange of the second connecting portion is positioned behind a front end surface of the corresponding upright extending wall.

In view of the above technical problems, the Present Disclosure further provides an electrical connector assembly, comprising a connecting member described as above. At least two fixed outer sheaths mounted on the second connecting portion of the connecting member and fixed to the second positioning portion, a receiving cavity is formed in each fixed outer sheath. At least two cable connector assemblies respectively inserted into the receiving cavities of the fixed outer sheaths correspondingly. A locking member mounted on the first connecting portion of the connecting member and fixed to the first positioning portion.

In another embodiment, an upper side of the fixed outer sheath is provided with a third connecting portion, the third connecting portion comprises two second protruding ribs spaced apart from each other and protruding upwardly and two second latching grooves respectively provided at two opposite inner sides of the two second protruding ribs. The first latching flange of the second connecting portion of the connecting member is correspondingly inserted into the second latching groove, and the second positioning portion of the connecting member abuts against a front edge of the third connecting portion. In another embodiment, a front end of the second latching groove of the fixed outer sheath is provided with a second stopping portion. The second stopping portion is provided at the front end of the first latching flange of the connecting member to limit a position of the connecting member inserted into the second latching groove forwardly, and the second positioning portion of the connecting member and the second protruding rib of the fixed outer sheath are cooperated to prevent the connecting member from being withdrawn rearwardly from the second latching groove.

In another embodiment, an underside of the second latching groove of the fixed outer sheath is provided with a second protruding portion protruding upwardly from an upper surface of the fixed outer sheath. In another embodiment, the locking member comprises a base plate, a latching portion formed at a front end of the base plate and at least one locking portion extending upwardly out from the base plate. The base plate is inserted onto the first connecting portion of the connecting member. The latching portion and the first positioning portion of the connecting member are engaged to fix the locking member and the connecting member together.

In another embodiment, the latching portion comprises a protruding hook extending downwardly out from the front end of the base plate and a latching hole penetrating the base plate up-down. The protruding hook abuts against an upper side of the resilient latching arm of the connecting member. The latching hole and the first positioning portion of the connecting member are engaged. In another embodiment, the base plate has two second latching flanges respectively extending outwardly out from both sides, the two second latching flanges are correspondingly inserted into the two first latching grooves of the connecting member.

Comparatively, as a result of the two connecting portions that are respectively formed at both sides (the upper side and the lower side) of the base portion, and a resilient latching arm extends out from the base portion and two positioning portions are respectively formed at both sides (upper side and lower side) of the resilient latching arm, the electrical connector assembly and the connecting member of the Present Disclosure can connect two or more cable connector assemblies together by virtue of the connecting portion and the positioning portion at the underside of the base portion, and further lock the two or more cable connector assemblies to an application device by that the connecting portion and the positioning portion at the upper side of the base portion and a locking member are engaged, so as to greatly improve the efficiency of expanding interfaces, and mounting is simple and convenient.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
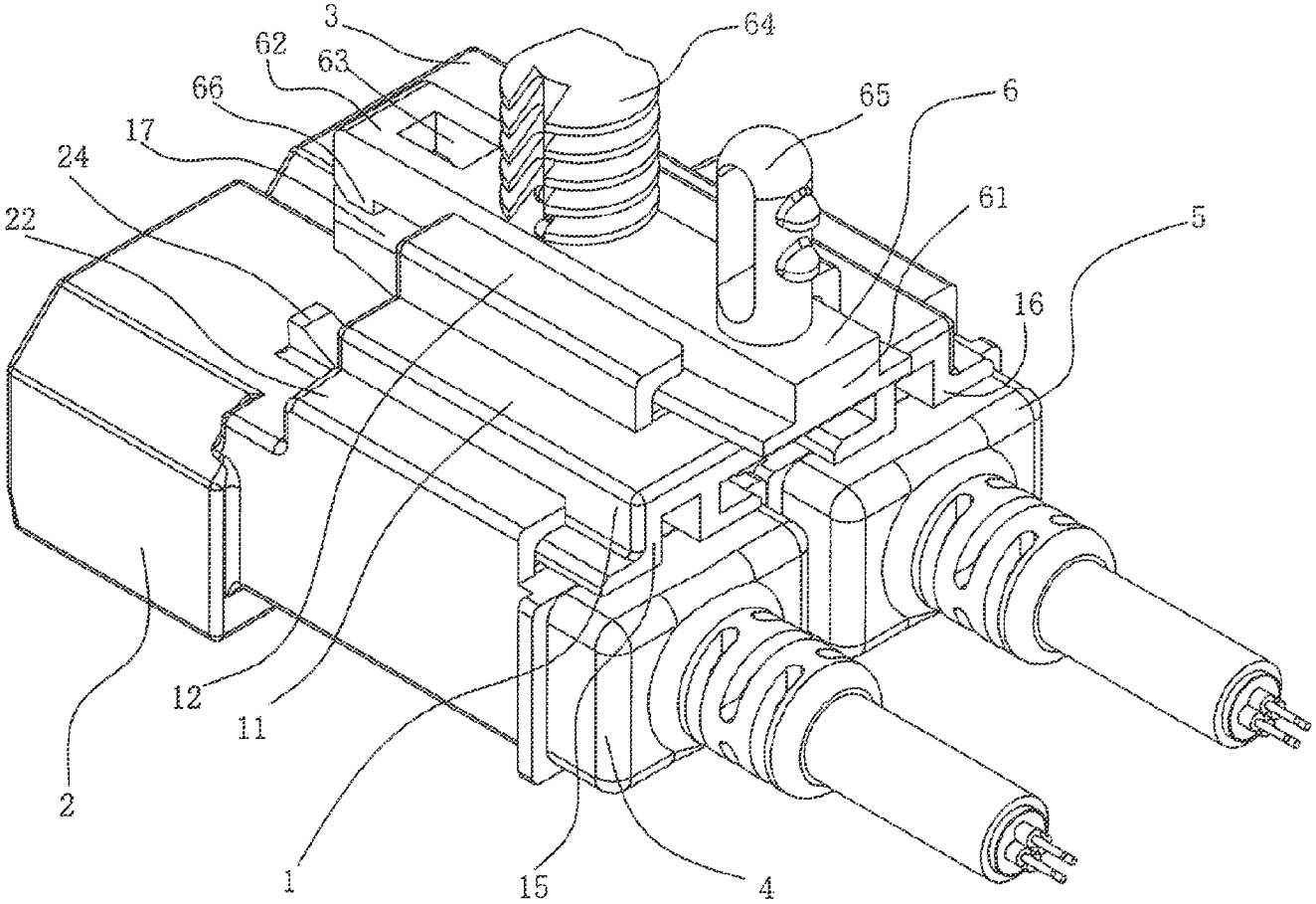
FIG. 1 is a perspective view of an electrical connector assembly of the Present Disclosure.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to FIGS. 1-4, the Present Disclosure provides an electrical connector assembly, which substantially comprises: a connecting member 1, two fixed outer sheaths 2, 3 mounted at an underside of the connecting member 1, two cable connector assemblies 4, 5 respectively inserted into the two fixed outer sheaths 2, 3 correspondingly, and a locking member 6 mounted above the connecting member 1. The electrical connector assembly can be fixed to an application device (not shown), such as an automobile or the like, via the locking member 6.

Referring to FIGS. 8-12, the connecting member 1 is integrally formed by inject molding, which comprises a base portion 11 having an upper surface 112 and a lower surface 113, a first connecting portion 12 comprising two first protruding ribs 13 spaced apart from each other and protruding upwardly from the upper surface 112 of the base portion 11, a second connecting portion 14 provided to the lower surface 113 of the base portion 11, having a first connecting unit 15 and a second connecting unit 16 and a resilient latching arm 17 extending horizontally out from one end of the base portion 11, having a first positioning portion 18 provided to an upper surface thereof and a second positioning portion 19 provided to a lower surface thereof. The first connecting portion 12 comprises two first latching grooves 131 extending along a front-rear direction and respectively provided at opposite inner sides of the two first protruding ribs 13, a front end of the each first latching groove 131 is provided with a first stopping portion 133 protruding downwardly, a rear part of the each first latching groove 131 is provided with a first protruding portion 132 protruding upwardly from the upper surface 112 of the base portion 11.

The first connecting unit 15 of the second connecting portion 14 has two upright extending walls 151, 153 spaced apart from each other and extending downwardly out from the lower surface 113 of the base portion 11 and two first latching flanges 152 respectively extending horizontally out oppositely from the two upright extending walls 151, 153, the two first latching flanges 152 and the lower surface 113 of the base portion 11 have a height difference therebetween. Lengths of the two first latching flanges 152 extending along the front-rear direction are smaller than lengths of the corresponding upright extending walls 151, 153 extending along the front-rear direction, specifically, a front end surface of the first latching flange 152 of the second connecting portion 14 is positioned behind a front end surface of the corresponding upright extending wall 151, 153, and a rear end surface of the first latching flange 152 is flush with a rear end surface of the corresponding upright extending wall 151, 153. In the embodiment, the first upright extending wall 151 and the first latching flange 152 form a first L-shaped structure, the second upright extending wall 153 and the first latching flange 152 form a second L-shaped structure, the second L-shaped structure and the first L-shaped structure are provided oppositely.

It is worth mentioning that, in the embodiment, the second connecting portion 14 is provided with a total of four L-shaped structures to lock the two fixed outer sheaths 2, 3; however, in other embodiments, only retaining the two L-shaped structures at a middle part or the two L-shaped structures at an outer side (not shown) can also achieve the purpose of locking the two fixed outer sheaths 2, 3. In the embodiment, the second connecting unit 16 is the same as the first connecting unit 15 in structure, and are spaced apart from each other and symmetrically arranged at both sides below the base portion 11, the two first latching flanges 152 of the first connecting unit 15 and the two first latching flanges of the second connecting unit 16 are positioned in the same horizontal plane. And in other embodiments (not shown), the structure of the second connecting unit 16 may be different from the structure of the first connecting unit 15; or the structures of them are same, but there are differences in size, so that the first latching flanges of the second connecting unit 16 and the two first latching flanges 152 of the first connecting unit 15 are positioned in different horizontal planes. In the embodiment, the second connecting portion 14 has two connecting units 15, 16 to engage two connecting structures (the fixed outer sheaths 2, 3 in the embodiment), and in other embodiments, the second connecting portion 14 may have three or more connecting units to correspondingly engage three or more connecting structures.

Figure 2:
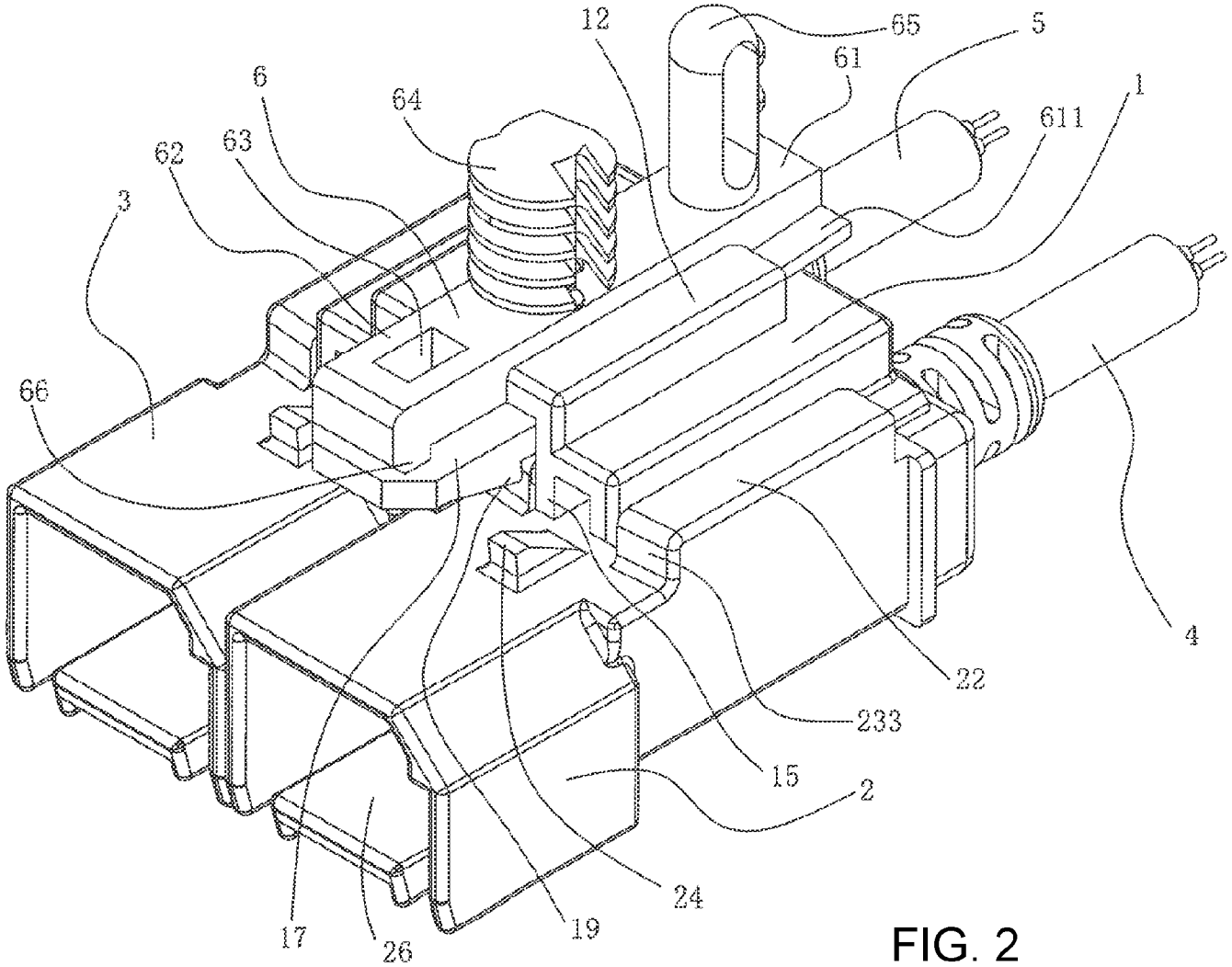
FIG. 2 is another perspective view of the electrical connector assembly of FIG. 1.
Figure 3:
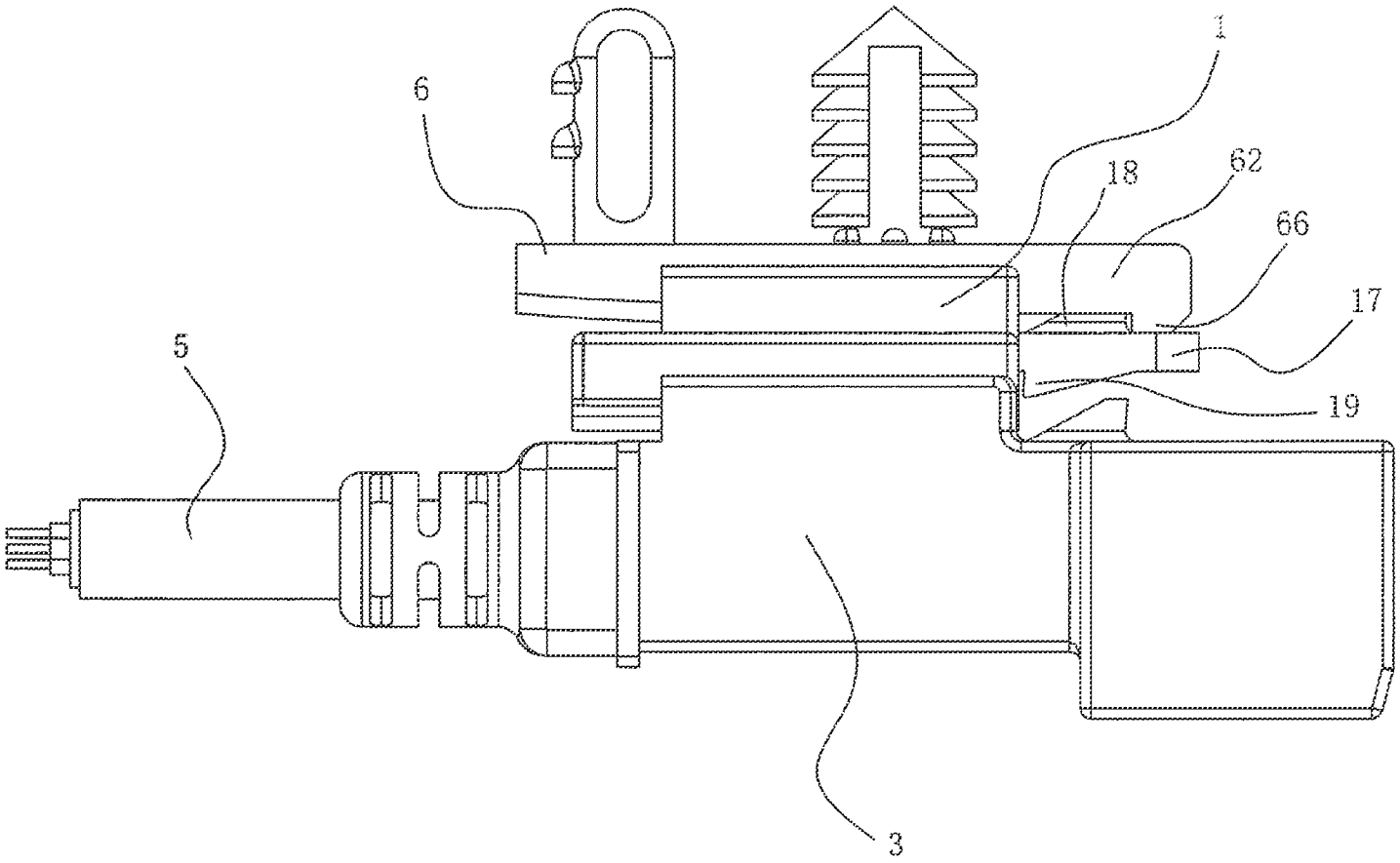
FIG. 3 is a side view of the electrical connector assembly of FIG. 1.
Figure 4:
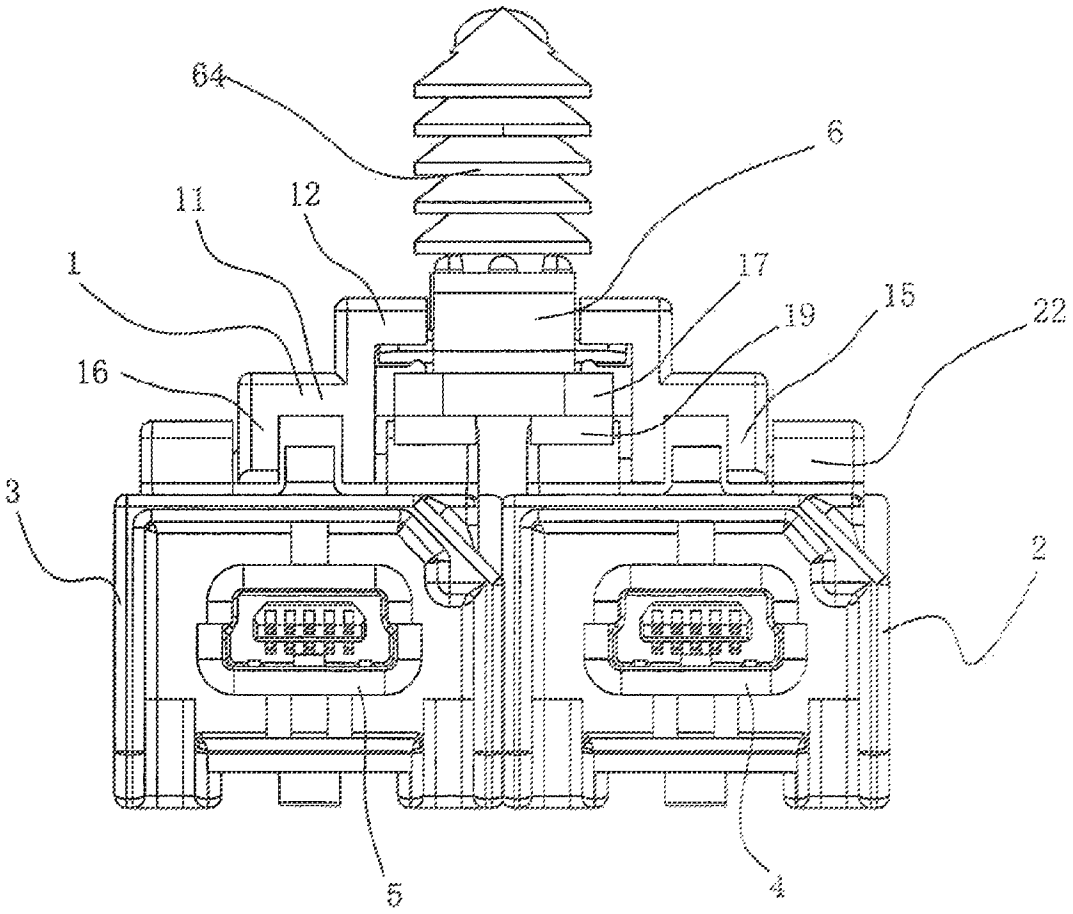
FIG. 4 is a front view of the electrical connector assembly of FIG. 1.
Figure 11:
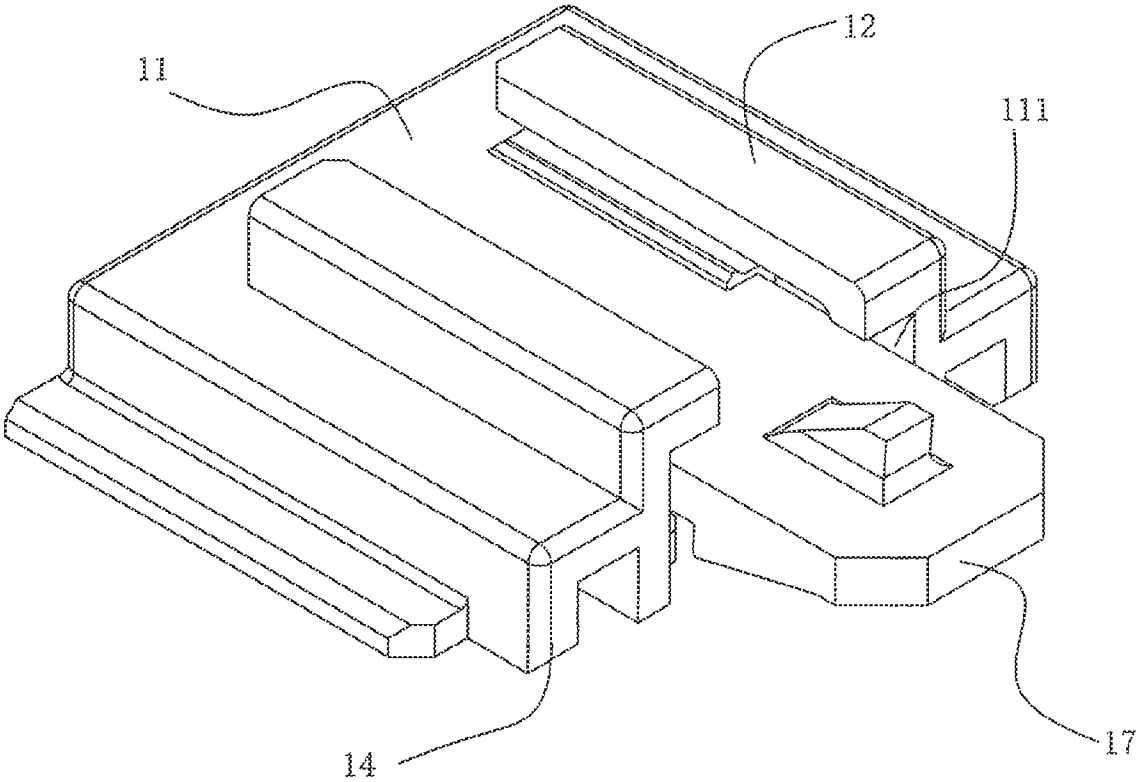
FIG. 11 is a perspective view of the embodiment of an electrical connecting member of FIG. 1.
Figure 12:
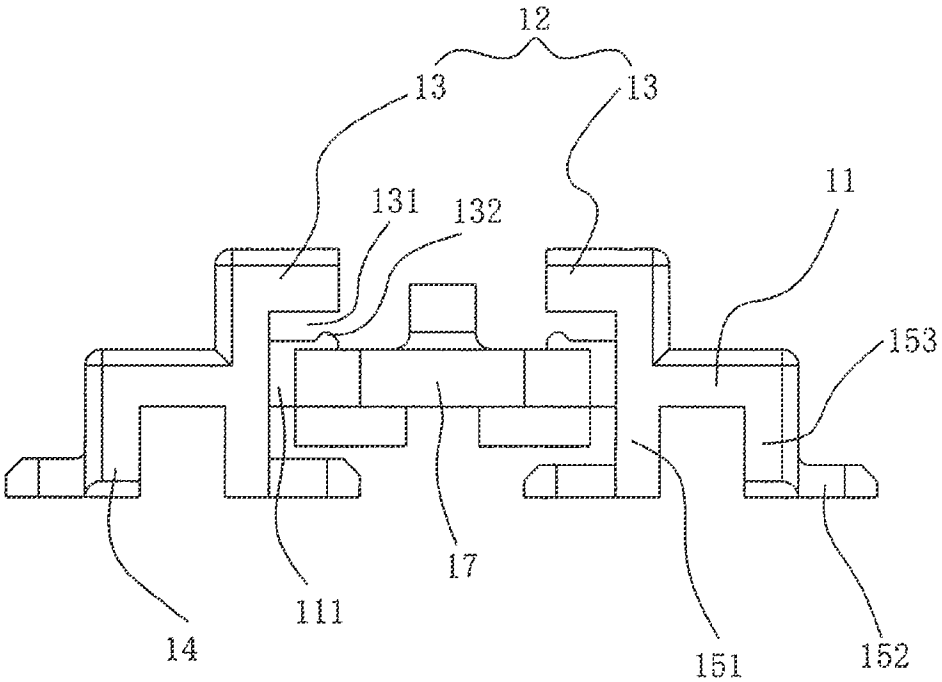
FIG. 12 is a front view of the embodiment of an electrical connecting member of FIG. 1.

Referring to FIGS. 11-2, specifically, in the embodiment, the resilient latching arm 17 extends forwardly out from the front end of the base portion 11, and preferably the base portion 11 is provided with two notches 111 which are positioned between the two first protruding ribs 13, spaced apart from each other and parallel extending, and opened at the front end of the base portion 11, the resilient latching arm 17 protrudes forwardly at inner sides of the two notches 111. Such notches 111 can allow the resilient latching arm 17 having an extending length long enough so as to achieve good elasticity, but the resilient latching arm 17 does not need to extend out from the front end of the base portion 11 too much so as to achieve miniaturization of products. The first positioning portion 18 is a first protruding block 181 protruding upwardly and provided close to a front end of the resilient latching arm 17, the first protruding block 181 has a first inclined guide surface 182 which is higher at the front and lower at the rear. The second positioning portion 19 is two second protruding blocks 191 (in other embodiments it can also be reduced to a second protruding block) protruding downwardly from both sides close to the front end of the resilient latching arm 17 and spaced apart from each other, the each second protruding block 191 has a second inclined guide surface 192 which is lower at the front and higher at the rear.

Figure 9:
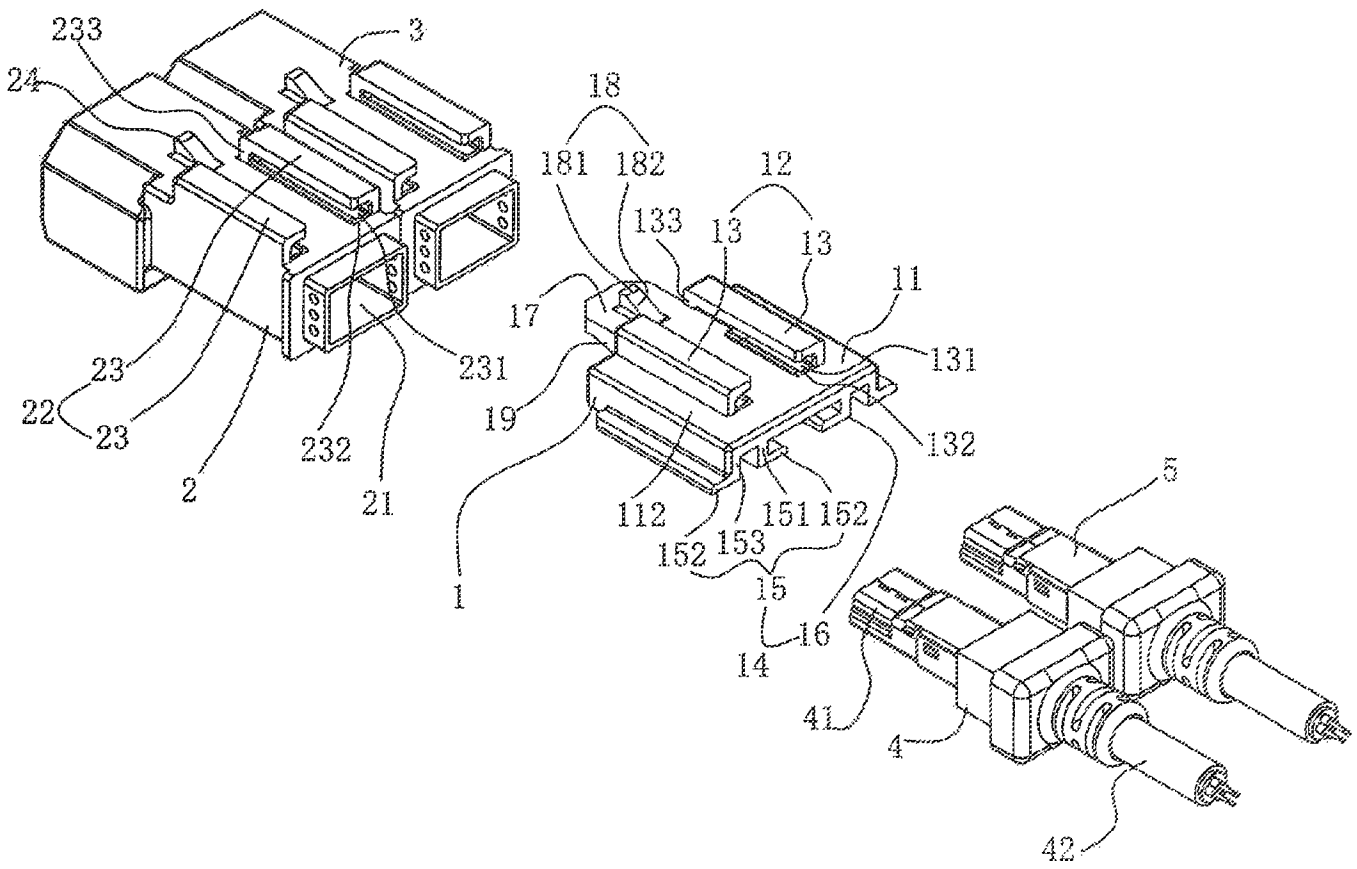
FIG. 9 is an exploded perspective view of the embodiment of the electrical connector assembly of FIG. 1, in which the locking member is removed.
Figure 10:
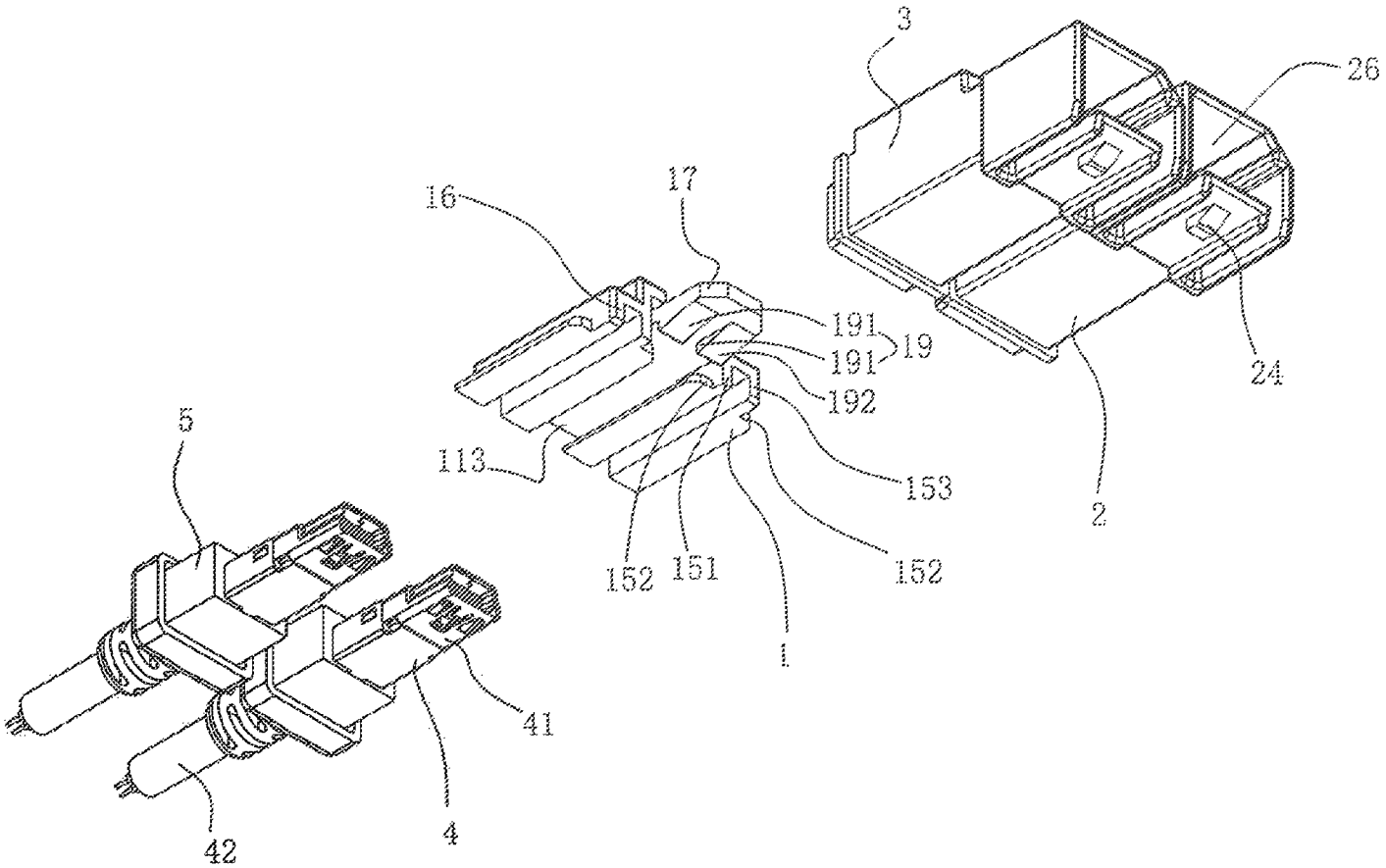
FIG. 10 is an exploded perspective view of the embodiment of the electrical connector assembly of FIG. 1, in which the locking member is removed.

Referring to FIGS. 9-10, in the embodiment, the first fixed outer sheath 2 and the second fixed outer sheath 3 have the same structure, and then the first fixed outer sheath 2 will be taken for description in details. The first fixed outer sheath 2 is integrally formed by inject molding, a middle part of the first fixed outer sheath 2 is formed with an receiving cavity 21. An upper side of the first fixed outer sheath 2 is provided with a third connecting portion 22, the third connecting portion 22 has two second protruding ribs 23 spaced apart from each other. Both sides (upper side and lower side) of the first fixed outer sheath 2 each are provided with a third positioning block 24. It is worth mentioning that, structures of the third connecting portion 22 and the third positioning block 24 are substantially the same as the structures of the first connecting portion 12 and the first positioning portion 18 of the connecting member 1.

The third connecting portion 22 further comprises two second latching grooves 231 extending along the front-rear direction and respectively provided at two opposite inner sides of the two second protruding ribs 23, a front end of the each second latching groove 231 is provided with a second stopping portion 233, an underside of the each second latching groove 231 is provided with a second protruding portion 232 protruding upwardly from an upper surface of the fixed outer sheath 2. When the connecting member 1 is inserted into the fixed outer sheath 2 from the rear to the front towards the second latching groove 231, the two first latching flanges 152 of the second connecting portion 14 of the connecting member 1 are correspondingly inserted into the two second latching grooves 231, and the second positioning portion 19 of the connecting member 1 abuts against a front edge of the third connecting portion 22. Specifically, a rear end surface of the second stopping portion 233 and front ends of the two first latching flanges 152 of the connecting member 1 are cooperated to limit a position of the connecting member 1 inserted into the second latching groove 231 forwardly, and a front end surface of the second stopping portion 233 and the second positioning portion 19 of the connecting member 1 are cooperated to prevent the connecting member 1 from being withdrawn rearwardly from the second latching groove 231 in the opposite direction, so as to securely fix and mount the first fixed outer sheath 2 to the first connecting unit 15 of the second connecting portion 14 of the connecting member 1. Similarly, the second fixed outer sheath 3 can be fixed and mounted to the second connecting unit 16 of the second connecting portion 14 of the connecting member 1. In other embodiments, the second fixed outer sheath 3 and the first fixed outer sheath 2 may have different structures.

Referring to FIG. 9, a structure of the first cable connector assembly 4 is the same as a structure of the second cable connector assembly 5, and then the first cable connector assembly 4 will be taken for description in details. The first cable connector assembly 4 comprises an electrical connector 41 and a cable 42 which are engaged together. The first cable connector assembly 4 may be correspondingly inserted into and fixed in the receiving cavity 21 of the first fixed outer sheath 2. The electrical connector 41 may mate with another mating electrical connector (not shown). In other embodiments, the second cable connector assembly 5 and the first cable connector assembly 4 may have different structures.

Figure 5:
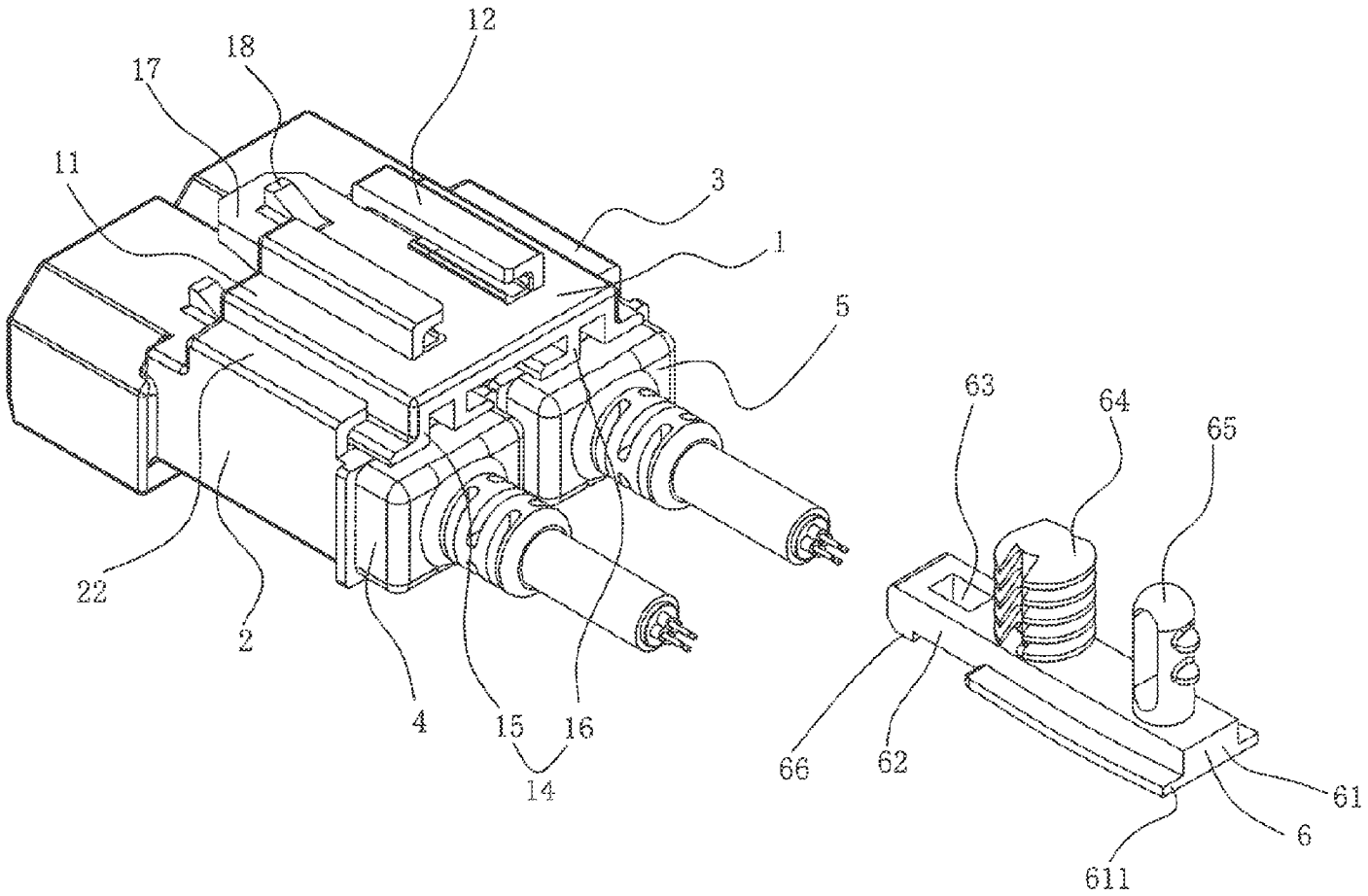
FIG. 5 is an exploded perspective view of the electrical connector assembly of FIG. 1.
Figure 6:
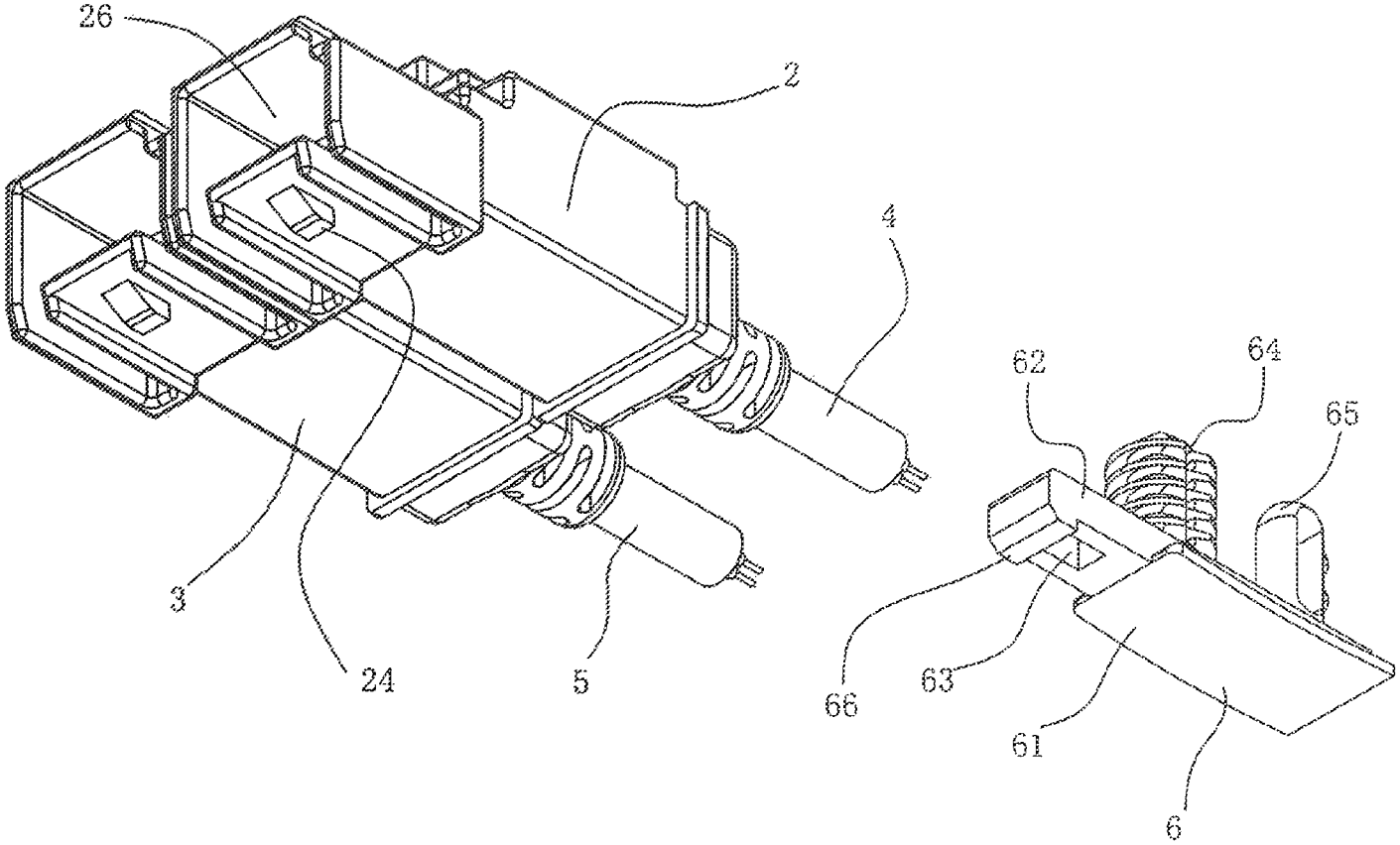
FIG. 6 is an exploded perspective view of the electrical connector assembly of FIG. 1.
Figure 7:
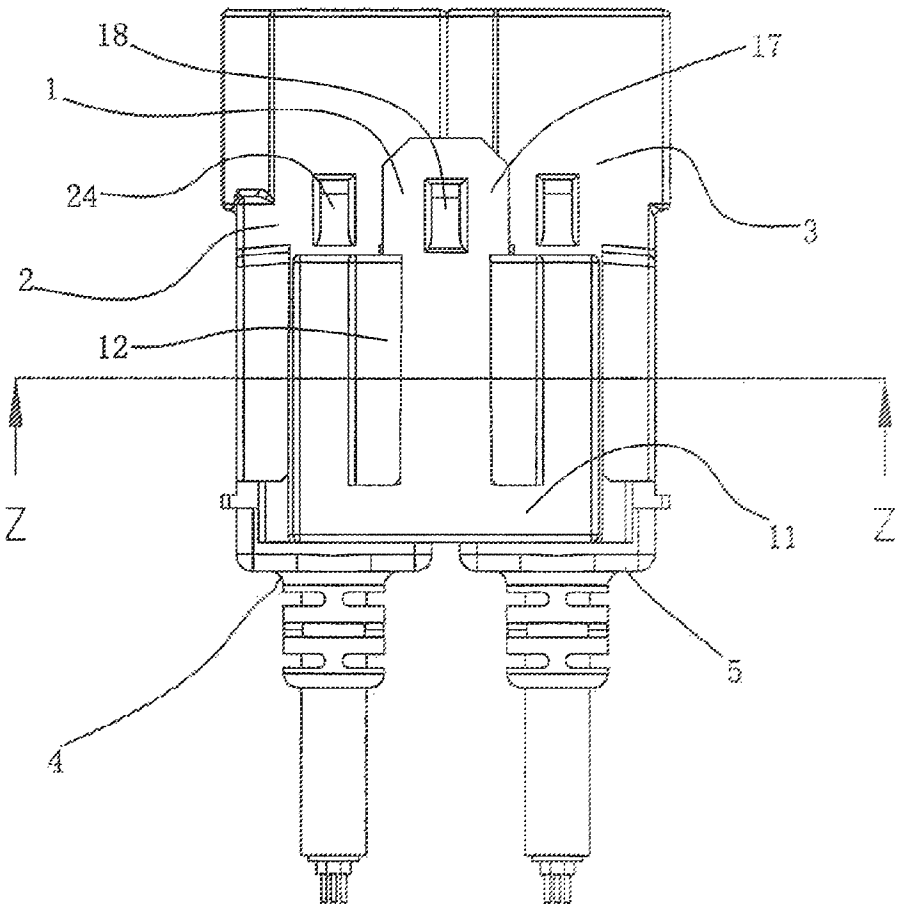
FIG. 7 is a top view of the embodiment of the electrical connector assembly of FIG. 1, in which the locking member is removed.
Figure 8:
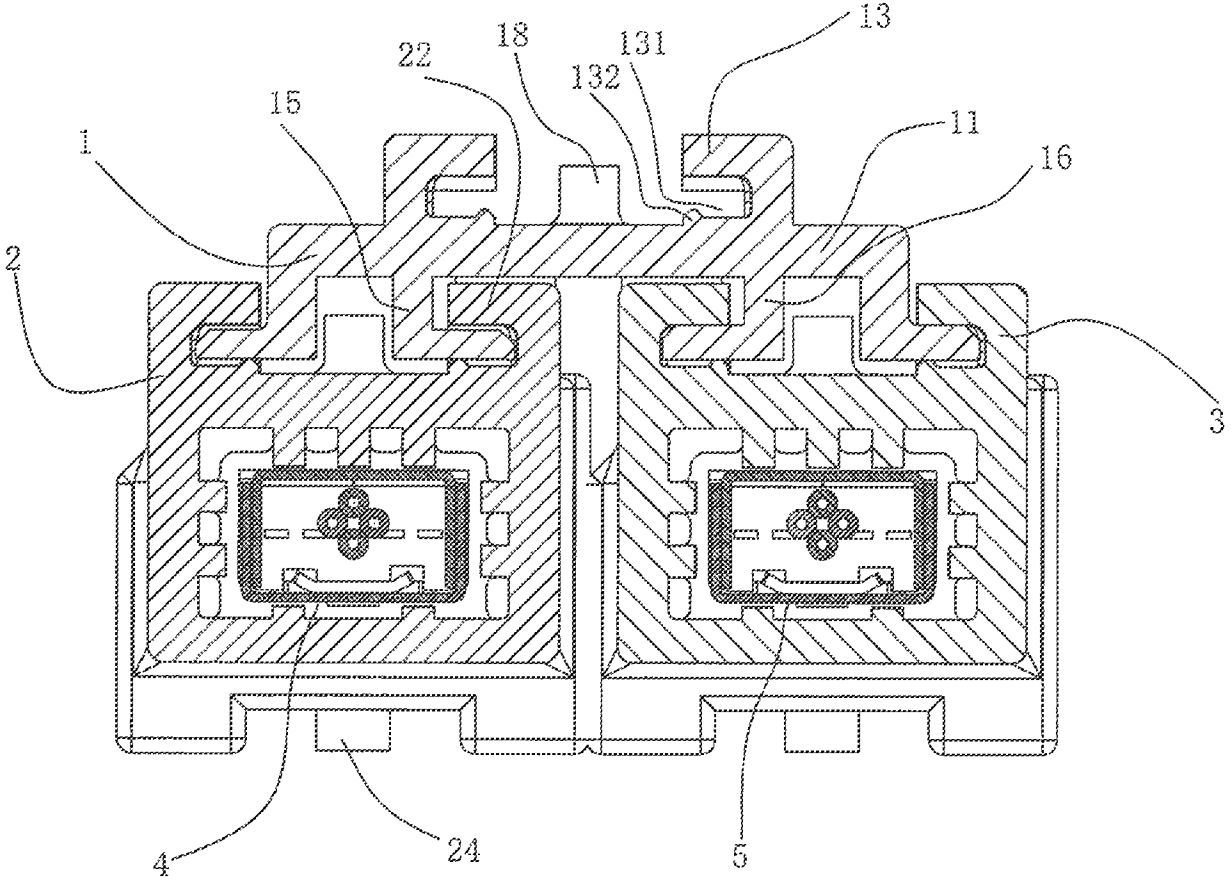
FIG. 8 is a cross-sectional view taken along Line Z-Z of FIG. 7.

Referring to FIGS. 5-6, the locking member 6 comprises a base plate 61, a latching portion 62 formed at a front end of the base plate 61 and two locking portions 64, 65 extending upwardly out from the base plate 61. The base plate 61 can be correspondingly inserted onto the first connecting portion 12 of the connecting member 1. Specifically, the base plate 61 has two second latching flanges 611 extending outwardly out from both sides thereof, respectively, the two second latching flanges 611 can be correspondingly inserted into the two first latching grooves 131 of the connecting member 1, that the two second latching flanges 611 and the first protruding portion 132 are cooperated can achieve effects of close engagement and low risk of disengagement. The latching portion 62 and the first positioning portion 18 of the connecting member 1 are engaged to fixedly connect the locking member 6 and the connecting member 1. Specifically, the latching portion 62 comprises a latching hole 63 penetrating the base plate 61 up-down close to a distal end of the base plate 61 and a protruding hook 66 extending downwardly out from the distal end of the base plate 61, the latching hole 63 and the protruding hook 66 can be latched with the first positioning portion 18 of the connecting member 1. The protruding hook 66 can further abut against an upper side of the resilient latching arm 17, so as to ensure that the second positioning portion 19 of the resilient latching arm 17 and the front edge of the second protruding rib 23 of the fixed outer sheath 2 are closely engaged and difficult to disengage upwardly, so that the connecting member 1 is difficulty withdrawn rearwardly from the second latching groove 231 in the opposite direction.

Regarding assembly, first, the first connecting unit 15 at the underside of the connecting member 1 is inserted onto the third connecting portion 22 of the first fixed outer sheath 2 from the rear to the front, the resilient latching arm 17 of the connecting member 1 firstly is resiliently raised upwardly under guiding of the second inclined guide surface 192, the resilient latching arm 17 then resiliently reset downwardly when reaching a locking position, so as to allow that the second positioning portion 19 and the second protruding rib 23 of the first fixed outer sheath 2 are engaged. Then, the second connecting unit 16 below the connecting member 1 is correspondingly inserted onto the third connecting portion of the second fixed outer sheath 3. Next, the second latching flange 611 of the locking member 6 is correspondingly inserted into the first latching groove 131 of first connecting portion 12 above the connecting member 1, the latching portion 62 of the locking member 6 firstly is resiliently raised upwardly under guiding of the first inclined guide surface 182, then resiliently reset downwardly when reaching a locking position, so as to allow that the latching portion 62 and the second positioning portion 19 of the connecting member 1 are engaged. Then, the first cable connector assembly 4 is correspondingly inserted into and fixed in the receiving cavity 21 of the first fixed outer sheath 2. Finally, the second cable connector assembly 5 is correspondingly inserted into and fixed in the receiving cavity of the second fixed outer sheath 3.

Compared with conventional assemblies, the electrical connector assembly and the connecting member thereof of the Present Disclosure have, inter alia, the following beneficial effects: The connecting member 1 can securely engage the two fixed outer sheaths 2, 3 and the two cable connector assemblies 4, 5 inserted into the fixed outer sheaths 2, 3 via the first latching flange 152 and the second positioning portion 19 which are integrally formed with the connecting member 1, which does not need other retaining pieces and mounting is simple and convenient; the above electrical connector assemblies are further locked to an application device, such as an automobile, via a locking member 6 correspondingly engaged with the first latching groove 131 and the first positioning portion 18 of the connecting member 1, so as to meet requirements for adding interfaces for the application device; in addition, the connecting member 1 of the Present Disclosure can be compatible and matched with the original fixed outer sheaths 2, 3 conveniently, facilitating expansion and modification and having low cost.

While a preferred embodiment of the Present Disclosure is shown and described, it is envisioned that those skilled in the art may devise various modifications without departing from the spirit and scope of the foregoing Description and the appended Claims.

What is claimed is:

1. A connecting member, the connecting member comprising:

a base portion, the base portion including an upper surface and a lower surface;

a first connecting portion, the first connecting portion including two first protruding ribs, spaced apart from each other and protruding upwardly from the upper surface of the base portion, and two first latching grooves, respectively provided at opposite inner sides of the two first protruding ribs, the two first latching grooves extending along a front-rear direction, wherein a front end of the first latching groove includes a first stopping portion, and an underside of the first latching groove includes a first protruding portion, the first protruding portion protruding upwardly from the upper surface of the base portion;

a second connecting portion, the second connecting portion including at least two upright extending walls, spaced apart from each other and extending downwardly out from the lower surface of the base portion, and at least two first latching flanges, respectively extending horizontally out from the at least two upright extending walls; and a resilient latching arm, the resilient latching arm extending out from one end of the base portion, the resilient latching arm including a first positioning portion provided to an upper surface thereof and a second positioning portion provided to a lower surface thereof.

2. The connecting member of claim 1, wherein the connecting member is integrally formed by injection molding.

3. The connecting member of claim 2, wherein the base portion is provided with two notches positioned between the two first protruding ribs, spaced apart from each other and opened at a front end of the base portion.

4. The connecting member of claim 3, wherein the resilient latching arm protrudes forwardly at inner sides of the two notches.

5. The connecting member of claim 1, wherein the first positioning portion is a first protruding block provided close to a front end of the resilient latching arm and protruding upwardly, the first protruding block including a first inclined guide surface higher at the front and lower at the rear.

6. The connecting member of claim 1, wherein the second positioning portion is a second protruding block provided close to the front end of the resilient latching arm and protruding downwardly, the second protruding block including a second inclined guide surface lower at the front and higher at the rear.

7. The connecting member of claim 1, wherein the second connecting portion includes four upright extending walls spaced apart from each other, extending downwardly out.

8. The connecting member of claim 7, wherein the second connecting portion further includes four first latching flanges extending horizontally out respectively from the four upright extending walls.

9. The connecting member of claim 8, wherein the two adjacent upright extending walls positioned at one side and the two first latching flanges extending oppositely out from bottom ends of the adjacent two upright extending walls to form a first connecting unit.

10. The connecting member of claim 9, wherein the two adjacent upright extending walls positioned at the other side and the two first latching flanges extending oppositely out from bottom ends of the two adjacent upright extending walls at the other side form a second connecting unit.

11. The connecting member of claim 10, wherein the two first latching flanges of the first connecting unit and the two first latching flanges of the second connecting unit are positioned in a same horizontal plane.

12. A connecting member, the connecting member comprising:

a base portion, the base portion including an upper surface and a lower surface;

a first connecting portion, the first connecting portion including two first protruding ribs, spaced apart from each other and protruding upwardly from the upper surface of the base portion, and two first latching grooves, respectively provided at opposite inner sides of the two first protruding ribs, the two first latching grooves extending along a front-rear direction;

a second connecting portion, the second connecting portion including at least two upright extending walls, spaced apart from each other and extending downwardly out from the lower surface of the base portion, and at least two first latching flanges, respectively extending horizontally out from the at least two upright extending walls, wherein a front end surface of the first latching flange of the second connecting portion is positioned behind a front end surface of the corresponding upright extending wall; and a resilient latching arm, the resilient latching arm extending out from one end of the base portion, the resilient latching arm including a first positioning portion provided to an upper surface thereof and a second positioning portion provided to a lower surface thereof.

13. An electrical connector assembly, comprising:

a connecting member, the connecting member including:

a base portion, the base portion including an upper surface and a lower surface;

a first connecting portion, the first connecting portion including two first protruding ribs, spaced apart from each other and protruding upwardly from the upper surface of the base portion, and two first latching grooves, respectively provided at opposite inner sides of the two first protruding ribs, the two first latching grooves extending along a front-rear direction;

a second connecting portion, the second connecting portion including at least two upright extending walls, spaced apart from each other and extending downwardly out from the lower surface of the base portion, and at least two first latching flanges, respectively extending horizontally out from the at least two upright extending walls; and a resilient latching arm, the resilient latching arm extending out from one end of the base portion, the resilient latching arm including a first positioning portion provided to an upper surface thereof and a second positioning portion provided to a lower surface thereof;

at least two fixed outer sheaths, each sheath being mounted on the second connecting portion and fixed to the second positioning portion, a receiving cavity being formed in each sheath, an upper side of one of the fixed outer sheaths is provided with a third connecting portion, the third connecting portion including two second protruding ribs, each rib being spaced apart from each other and protruding upwardly, and two second latching grooves, respectively provided at two opposite inner sides of the two second protruding ribs, the first latching flange being inserted into the second latching groove, and the second positioning portion abuts against a front edge of the third connecting portion;

at least two cable connector assemblies, each connector assembly being inserted into one of the receiving cavities; and a locking member, the locking member being mounted on the first connecting portion and fixed to the first positioning portion.

14. The electrical connector assembly of claim 13, wherein:

a front end of one of the second latching grooves is provided with a second stopping portion;

the second stopping portion is provided at the front end of the first latching flange to limit a position of the connecting member inserted into the second latching groove forwardly; and the second positioning portion and the second protruding rib cooperate to prevent the connecting member from being withdrawn rearwardly from the second latching groove.

15. The electrical connector assembly of claim 13, wherein an underside of the second latching groove includes a second protruding portion, the second protruding portion protruding upwardly from an upper surface of the fixed outer sheath.

16. An electrical connector assembly, comprising:

a connecting member, the connecting member including:

a base portion, the base portion including an upper surface and a lower surface;

a first connecting portion, the first connecting portion including two first protruding ribs, spaced apart from each other and protruding upwardly from the upper surface of the base portion, and two first latching grooves, respectively provided at opposite inner sides of the two first protruding ribs, the two first latching grooves extending along a front-rear direction;

a second connecting portion, the second connecting portion including at least two upright extending walls, spaced apart from each other and extending downwardly out from the lower surface of the base portion, and at least two first latching flanges, respectively extending horizontally out from the at least two upright extending walls; and a resilient latching arm, the resilient latching arm extending out from one end of the base portion, the resilient latching arm including a first positioning portion provided to an upper surface thereof and a second positioning portion provided to a lower surface thereof;

at least two fixed outer sheaths, each sheath being mounted on the second connecting portion and fixed to the second positioning portion, a receiving cavity being formed in each sheath;

at least two cable connector assemblies, each connector assembly being inserted into one of the receiving cavities; and a locking member, the locking member being mounted on the first connecting portion and fixed to the first positioning portion, the locking member includes a base plate, a latching portion formed at a front end of the base plate and at least one locking portion extending upwardly out from the base plate, the base plate being inserted onto the first connecting portion, the latching portion and the first positioning portion being engaged to fix the locking member and the connecting member together, wherein the latching portion including a protruding hook extending downwardly out from the front end of the base plate and a latching hole penetrating the base plate up-down, the protruding hook abutting against an upper side of the resilient latching arm, the latching hole and the first positioning portion being engaged.

17. An electrical connector assembly, comprising:

a connecting member, the connecting member including:

a base portion, the base portion including an upper surface and a lower surface;

a first connecting portion, the first connecting portion including two first protruding ribs, spaced apart from each other and protruding upwardly from the upper surface of the base portion, and two first latching grooves, respectively provided at opposite inner sides of the two first protruding ribs, the two first latching grooves extending along a front-rear direction;

a second connecting portion, the second connecting portion including at least two upright extending walls, spaced apart from each other and extending downwardly out from the lower surface of the base portion, and at least two first latching flanges, respectively extending horizontally out from the at least two upright extending walls; and a resilient latching arm, the resilient latching arm extending out from one end of the base portion, the resilient latching arm including a first positioning portion provided to an upper surface thereof and a second positioning portion provided to a lower surface thereof;

at least two fixed outer sheaths, each sheath being mounted on the second connecting portion and fixed to the second positioning portion, a receiving cavity being formed in each sheath;

at least two cable connector assemblies, each connector assembly being inserted into one of the receiving cavities; and a locking member, the locking member being mounted on the first connecting portion and fixed to the first positioning portion, the locking member includes a base plate, a latching portion formed at a front end of the base plate and at least one locking portion extending upwardly out from the base plate, the base plate being inserted onto the first connecting portion, the latching portion and the first positioning portion being engaged to fix the locking member and the connecting member together, wherein the base plate includes two second latching flanges extending outwardly from both sides, the two second latching flanges being inserted into the two first latching grooves.

* * * * *